350-336
PTU20 XR 4,342,030

United States Patent [19]
Shanks

[11] 4,342,030
[45] Jul. 27, 1982

[54] ANALOGUE DISPLAYS FOR ELECTRONIC TIMEPIECES OR METERS

[75] Inventor: Ian A. Shanks, Malvern, England

[73] Assignee: National Research Development Corporation, London, England

[21] Appl. No.: 128,059

[22] Filed: Mar. 7, 1980

[30] Foreign Application Priority Data

Mar. 13, 1979 [GB] United Kingdom ..... 7908903

[51] Int. Cl.³ ..... G09G 3/36

[52] U.S. Cl. ..... 340/753; 340/754; 340/765; 340/784; 368/242

[58] Field of Search ..... 340/753, 754, 784, 765, 340/774, 756, 752, 783; 368/239, 240, 242

[56] References Cited

U.S. PATENT DOCUMENTS

| | | | |
|---|---|---|---|
| 3,525,091 | 8/1970 | Lally | 340/753 |
| 3,540,209 | 11/1970 | Zatsky et al. | 340/753 |
| 3,881,311 | 5/1975 | Hama et al. | 340/756 |
| 3,934,241 | 1/1976 | Weigert | 340/753 |
| 3,959,963 | 6/1976 | Murrell | 340/753 |
| 3,987,617 | 10/1976 | Slob | 340/753 |
| 4,079,369 | 3/1978 | Fukumoto | 340/753 |
| 4,213,294 | 7/1980 | Freeman | 368/242 |

FOREIGN PATENT DOCUMENTS

| | | |
|---|---|---|
| 2165421 | 7/1972 | Fed. Rep. of Germany . |
| 2224189 | 11/1973 | Fed. Rep. of Germany . |
| 2232632 | 1/1974 | Fed. Rep. of Germany . |
| 2515684 | 11/1975 | Fed. Rep. of Germany . |
| 2551541 | 5/1977 | Fed. Rep. of Germany . |
| 2652576 | 6/1977 | Fed. Rep. of Germany . |
| WO79/00676 | 9/1979 | PCT Int.'l Appl. . |
| 1489435 | 10/1977 | United Kingdom . |
| 2011143A | 7/1979 | United Kingdom . |

OTHER PUBLICATIONS

Conference Record of IEEE Biennial Display Research Conference, 24–26 Oct. 1978, pp. 59–61 (Gruebel et al).

*Primary Examiner*—Marshall M. Curtis
*Attorney, Agent, or Firm*—Pollock, VandeSande and Priddy

[57] ABSTRACT

An analogue display with a panel having an electro-optic medium contained between two sets of electrodes. One set is arranged in a plurality of segments each divided into inner and outer portions. Each portion is planar and has a plurality of digits. The digits of one portion are interposed alternate with, and in between, the digits of the other. The other set has a planar meander configuration modified by an electrode interposed in its folds. The sets of electrodes when registered one over the other define two subsets of different selectable index positions. Selected alternating voltages are applied simultaneously to the electrodes maintaining the panel ON at two selected index positions and OFF elsewhere a dial shaped display area which is other than circular or arcuate, e.g. Preferably the voltages are selected from the set (+2V, +V, −V) of RMS magnitudes ($2V_c$, $V_c$, $V_c$) where $V_c$ is equal to the threshold voltage of the panel. The panel may contain liquid crystal material, as medium, to perform as a dyed phase change, or twisted nematic effect device.

16 Claims, 7 Drawing Figures

ANALOGUE DISPLAYS FOR ELECTRONIC TIMEPIECES OR METERS

BACKGROUND OF THE INVENTION

This invention concerns analogue displays, for example timepieces (ie watches or clocks) and analogue meter displays having dial, arc or rectilinear scales where a scalar quantity is represented by the relative position of two indices against an optically contrasting background.

Analogue watches and analogue meter displays have typically been of either mechanical or electromechanical construction. However, one example of a display of non-mechanical construction, a liquid crystal device analogue watch having a radial display format, has recently been described (cf. Conference Record of the IEEE Biennial Display Research Conference Oct. 24–26, 1978, pp 59–61). As there described, a set of electrodes of conventional meander configuration overlap inner and outer spaced sets of segment electrodes across a liquid crystal cell and are addressed using ½-duty cycle time-multiplexing to allow the simultaneous display of both hour and minute function indices. By appropriate electrical address the voltage $V_{on}$ across electrodes defining the index position, in each case, is of such value above a threshold value $V_{th}$, characteristic of the liquid crystal material, that a localized region of the liquid crystal material is switched ON and adopts a state providing optical contrast with the adjacent and remaining parts of the display where voltage differences $V_{off}$ less than but near threshold are applied. This allows the number of connections to the display to be reduced compared to the number required to make individual connection to each directly driven active area of the display.

The performance limits of liquid crystal displays at a given temperature are determined by the values of the voltage differences $V_{on}$, $V_{off}$ applied. It is desirable for good optical contrast that the voltage difference $V_{on}$ approaches or is greater than the saturation voltage difference $V_{sat}$ required to drive the optical response of the liquid crystal display into the fully ON state, while at the same time it is necessary, for effective operation, that the voltage difference $V_{off}$ is at most less than or equal to the threshold voltage characteristic of the display. Further limitations arise, however, because both the threshold voltage $V_{th}$ and the saturation voltage $V_{sat}$, characteristic of the display, vary with temperature. They may also vary with the angle of view. It is desirable, therefore, that the ratio of the R.M.S. average voltage differences—$R = \langle V_{on} \rangle RMS / \langle V_{off} \rangle RMS$ is optimized to be as large as possible.

The best value of this ratio R that has been achieved for two-function display time-multiplexed devices is ~2.25 (cf. Conference Record of the IEEE Biennial Display Research Conference Oct. 24–26, 1978, pp 59–61.)

The problems encountered with electro-luminescent panel displays and gas discharge displays are in many respects similar to those referred to above.

One approach to these problems of index display has been disclosed at the Seminar on Liquid Crystal Devices, San Jose, 7–8 February 1979. As there described, pseudo-random coded binary voltage signals are applied, after appropriate selection, to a set of electrodes of modified meander configuration, and to a set of segment electrodes. The voltage signals are applied so that the display is maintained, at selected index positions, in the OFF state, corresponding to an applied zero voltage difference, while all other regions of the display are maintained in the ON state. With this approach it is possible to achieve high (even infinite) values of the ratio R and to extend the performance limits of analogue displays. However, though this approach is satisfactory for many applications, it can have a number of drawbacks. Relatively high drive voltage signal levels may be required, and the spacings between electrodes can result in an undesirable visible background pattern. Also, when a liquid crystal medium containing pleochroic dye is used, it is frequently only possible to display the indices as dark characters (OFF state) against a light background (ON state). This is certainly the case where this technique disclosed is used for a display panel including a layer of cholesteric liquid crystal material of positive dielectric anisotropy with pleochroic dye, the panel being arranged as a dyed cholesteric-to-nematic phase change effect device. Reverse effects ie light characters (OFF state) against a dark background (ON state) could be provided by other dyed liquid crystal display panels known in the art—eg panels providing hometropic alignment of dyed long pitch cholesteric material, which material exhibits—ve dielectric anisotropy. In such panels the liquid crystal material spontaneously adopts a nematic phase (OFF state, light) and is driven upon application of an appropriate electric field across the panel, with a cholesteric planar texture (ON state, dark). The contrast and brightness of such panels, however, is, in general, inferior to that obtained for dyed cholesteric-to-nematic phase change effect devices.

An alternative approach to the problems of two-index character display is described below. It is an advantage of the invention that the attainable contrast and brightness is in general better than that provided by displays having time multiplexed address.

SUMMARY OF THE INVENTION

According to the present invention there is provided an analogue display comprising in cooperative combination:—a display panel; a signal generator for providing a set of voltage signals for address of the display panel; and, a signal selector responsive to input data for selecting and channeling the signals to the display panel; the display panel including a layer of an electrically sensitive medium contained between insulating front and rear substrates each having on an inwardly facing surface thereof a set of electrodes, the front substrate being transparent, the medium being capable of adopting in different regions thereof each of two optical states, an ON state, and, an OFF state, respectively, according to the electrical voltage differences applied thereacross when voltage signals are applied to the electrodes, one set of electrodes having a plurality of segments, each segment being divided into an inner and an outer portion arranged interdigitally, the other set of electrodes having a configuration in which a single electrode is interposed between meandering electrodes in folds formed by the meandering electrodes to form collectively a modified meander structure, the two sets of electrodes being in registered relationship so as to define a plurality of selectable index positions for representing a scalar quantity;

characterized in that the signal generator and signal selector are constructed and combined to maintain the panel in the ON state at two different selected index positions simultaneously, and in the OFF state at all other selectable index positions.

The analogue display may be adapted as a timepiece or analogue meter display having a circular dial or arc display area, with each segment having a circle-segment shaped boundary. Alternatively the analogue display may be adapted as a timepiece or analogue meter display having a dial shaped display area which is other than circular or arcuate, e.g., a rectilinear display area, with each segment having a rectangular shaped boundary.

The voltage signals provided by the generator and selected by the selector may be applied directly to the panel. Alternatively the voltage signals provided by the generator and selected by the selector may be applied indirectly to the panel, the provided and selected signals being scaled by driver amplifiers.

In the above constructions, values of the ratio R greater than 2.25 may be achieved by appropriate choice of the voltage signals.

Preferably the generator and the selector are constructed and arranged so that the ratio of the RMS average voltage differences between signals applied in use is substantially equal to 3, the RMS average voltage difference of the OFF state, $\langle V_{off}\rangle$RMS, being not greater than the threshold voltage $V_{th}$ of the medium at the operative temperature:

$$R = \langle V_{on}\rangle RMS / \langle V_{off}\rangle RMS = 3,$$
$$\langle V_{off}\rangle RMS \leqq V_{th}.$$

Electronic temperature compensation may be provided in conventional manner so that the condition: $\langle V_{off}\rangle RMS \leqq V_{th}$ holds over a broad range of operative temperatures.

Where signals are applied to the display panel directly: the generator may be constructed to provide a set of alternating voltage signals (+2 V, +V, −V), the signals +V and −V, respectively, being in-phase and in anti-phase with the signal +2 V, the set of signals having RMS magnitudes 2 $V_c$, $V_c$ and $V_c$ where the voltage magnitude $V_c$ is not greater than the threshold voltage $V_{th}$ characteristic of the display panel at an operative temperature; and the generator, and the selector, may be constructed and arranged to cooperate so that when the set of signals (+2 V, +V, −V) and a signal of zero voltage magnitude are applied directly to the display panel, an RMS voltage difference of magnitude 3 $V_c$ is developed at two selected index character positions, and, an RMS voltage difference of magnitude $V_c$ is developed at other non-selected index character positions.

Alternatively, the generator may be constructed to provide the set of alternating voltage signals (+2 V, +V, −V) which have added thereto a common voltage signal ΔV, of alternating or of steady nature, the generator and the selector being constructed and arranged to cooperate so that signals (+2 V and ΔV, +V and ΔV, −V and ΔV, and ΔV) are applied directly to the display panel.

Preferably, for optimum contrast, the voltage $V_c$ is substantially equal to the threshold voltage $V_{th}$.

When signals (+2 V, +V, −V) are applied to the display panel indirectly, the RMS magnitudes of the signals provided may be such that the signals applied to the display panel after scaling by the display drivers have either the RMS magnitudes 2 $V_c$, $V_c$ and $V_c$, or differ from these by a common magnitude.

BRIEF DESCRIPTION OF THE DRAWINGS

Embodiments of the invention will now be described, by way of example only, and with reference to the accompanying drawings of which.

DESCRIPTION OF THE PREFERRED EMBODIMENTS

Figure 1:
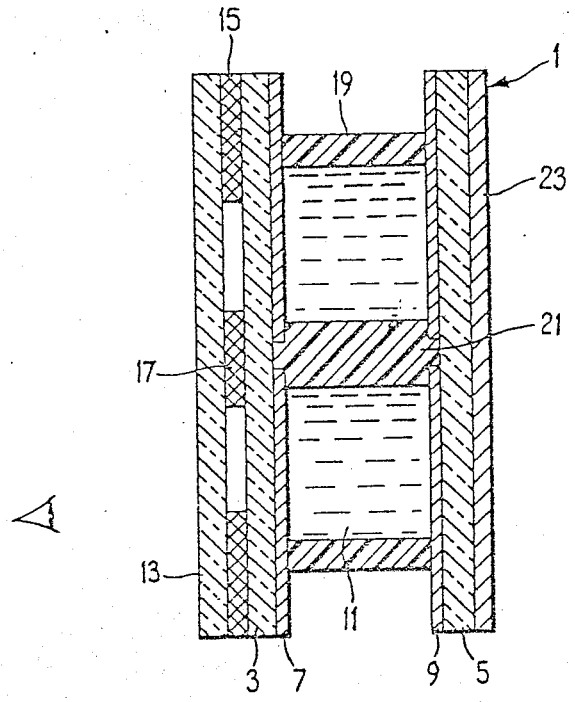
FIG. 1 is an illustrative cross-section of a display panel including front, and back-plate electrodes.

There is shown in FIG. 1 a display panel 1 having parallel front and back glass plates 3, 5 bearing on their inner facing surfaces electrode structures 7, 9. These structures may be formed by conventional photolithographic techniques and of these structures, at least the front structure 7 is transparent and may be of tin oxide or other suitable conductive material. A typical tin oxide film thickness is ~$10^4$ Å with resistivity ~1 to 1000Ω/□. The plates 3, 5 are spaced apart and have, in the space between, an electrically sensitive medium 11, the medium being characterized by the property that, in regions where the two electrode structures overlap, it may be changed from one optical state (eg opaque) to another (eg transparent) when suitable voltages are applied to the electrodes of each of the structures 7, 9. In front of the front plate 3 there is a cover glass 13 and between these an opaque graduated scale 15 and a central masking blank 17.

Though the medium 11 may be a solid layer of electroluminescent material, as in the case of an electroluminescent display panel; or, a rarefied gas, as in the case of an AC plasma discharge panel; for the purposes of this example it is a layer of liquid crystal material. The display panel thus adapted, is in the form of a liquid crystal cell where the liquid crystal material is enclosed in the space between the glass plates 3, 5 by a peripheral spacer 19 of insulating material. For added rigidity there is also a central support 21, also of insulating material. The plates 3, 5 are spaced apart by a short distance, typically of the order of 12 μm, to allow surface effect alignment of the liquid crystal material molecules to propagate across the width of the cell. To facilitate initial alignment of these molecules, the electrode bearing plates 3, 5 may be assembled: after unidirectionally rubbing, or, coating the electrodes by suitable oblique evaporation; or after treatment with a surfactant, such as organo-silane or lecithin, according to the liquid crystal effect used to define the different optical states, and the alignment required for display.

In particular, for a cell using the cholesteric-to-nematic phase change effect the liquid crystal material is cholesteric and the plates may be treated by surfactant to give focal conic alignment. Examples of suitable cholesteric mixtures for such a cell are the mixtures:

E8* (nematic) with approx 6 wt % CB 15* (cholesteric), or

E18* (nematic) with approx 6 wt % CB 15* (cholesteric).

Preferably these cholesteric materials include in addition a small amount of pleochroic dye. For example an anthraquinone dye such as D16* (See also European Patent Application No. 002104):

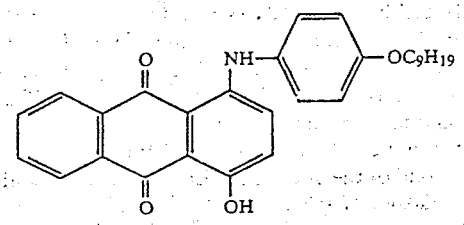

or one or more of the azo dyes (a) to (c) appearing below, of which the colors are (a) orange-red, (b) blue, and (c) magenta:

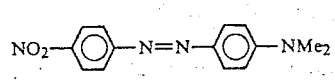

(a)

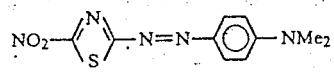

(b)

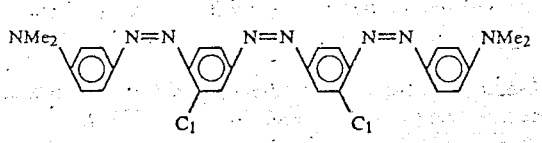

(c)

While the liquid crystal cell, so far as described above, may be viewed with back illumination, it is here shown as a reflective device and has, adjacent the back plate 5, a reflector 23 which may be a specular or diffusely reflecting metal film (eg silver, aluminum), or, a diffusely reflecting white paint, or card.

The electrode bearing plates 3, 5 extend beyond the spacer 19 to facilitate external connection to the electrode structures 7, 9.

Particular configurations of the electrode structures 7, 9 are now described with reference to FIGS. 2, 3 and 4. These configurations are suited to displays operated to perform as meters requiring the simultaneous display of two index characters.

Figure 2:
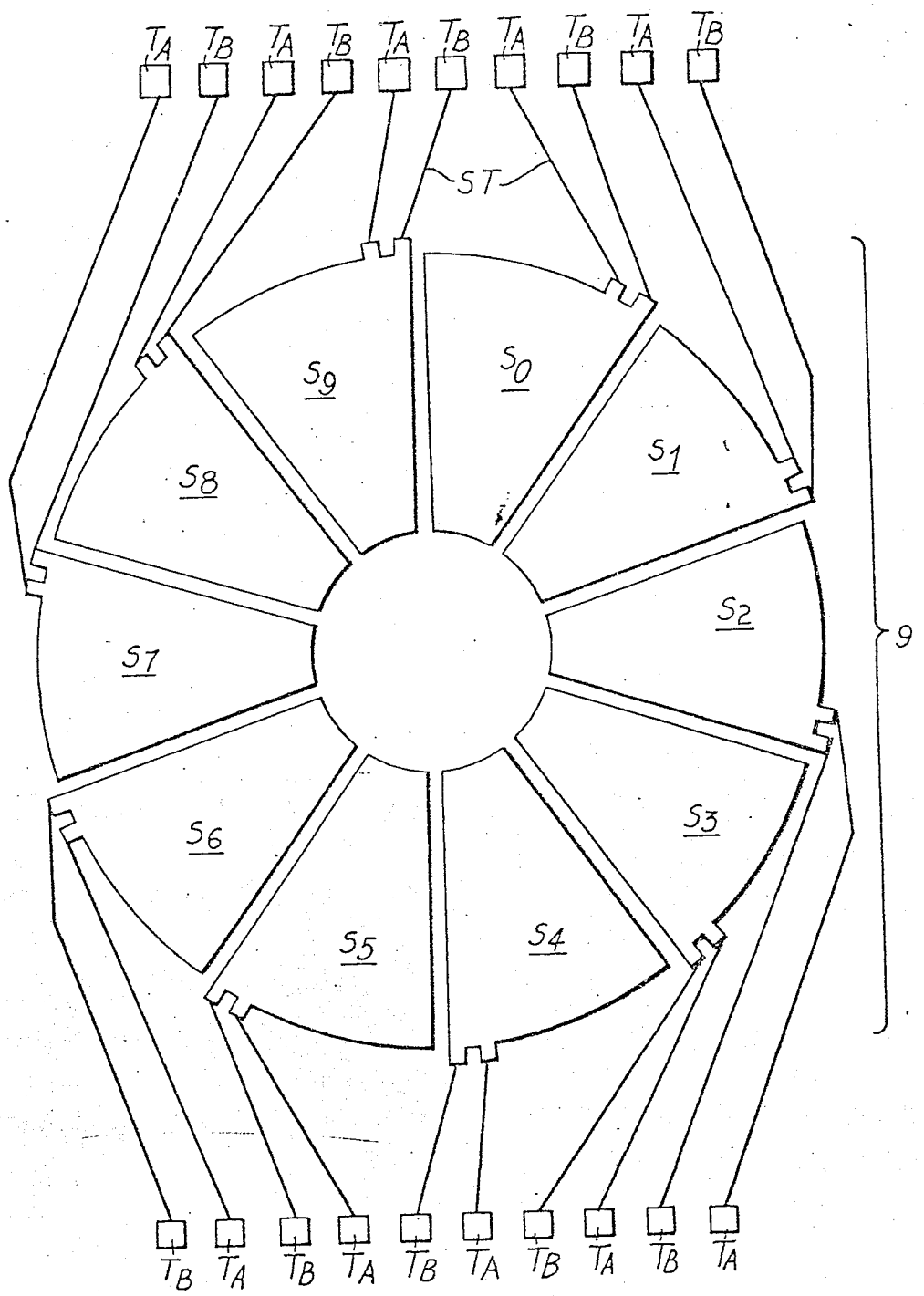
FIG. 2 is an outline illustration of the back-plate segmented electrodes of the display panel of FIG. 1.

The back electrode structure 9 is divided into ten segments S0 to S9 and these segments are arranged in a circular array, as shown in FIG. 2. Each of these segments lies within a circular boundary and is further divided into two portions, each electrically separate from the other, an outer portion and an inner portion. Thus, as shown in FIG. 3, the segment S0 is divided into an outer portion S0A and an inner portion S0B. The outer portion of each segment has five inwardly extending limbs l all spaced about the inner circumference of an arcuate strip ll. The inner portion of each segment similarly has five outwardly extending limbs s all spaced about the outer circumference of an inner arcuate strip ss. The limbs l and s of each segment are inter-related having an intergital construction, as shown. The limbs l and s are arranged about a circle and correspond to one or other of the inner and outer segment portions taken alternatively in consecutive order around the circle. Each of these limbs is shaped to provide, respectively, long and short hand pointer shaped regions of overlap with the front-plate electrode structure 7, these overlap regions l and s being shown in broken and in full outline in FIG. 3.

Each of the outer segment portions S0A to S9A is connected to one of a corresponding number of terminal pads TA by a conductive strip ST (shown schematically). Inner segment portions S0B to S9B are connected in similar manner to another set of terminal pads TB.

The front-plate electrode structure 7 has a modified meander configuration and comprises ten electrodes E0 to E9. As shown in FIG. 4, electrodes E1 to E9 have a folded configuration. In each fold of this configuration there is interposed a limb of the electrode E0. The electrode E0 is of complex shape having inwardly extending limbs Ea connected by an outer arcuate strip Eb, and alternating with these, outwardly extending limbs Ec connected by an inner arcuate strip Ed. One of the outwardly extending limbs Edb extends to the periphery of the meander construction and connects with the outer arcuate strip Eb. All limbs of electrode E0, therefore, form a single electrically connected structure.

Figure 3:
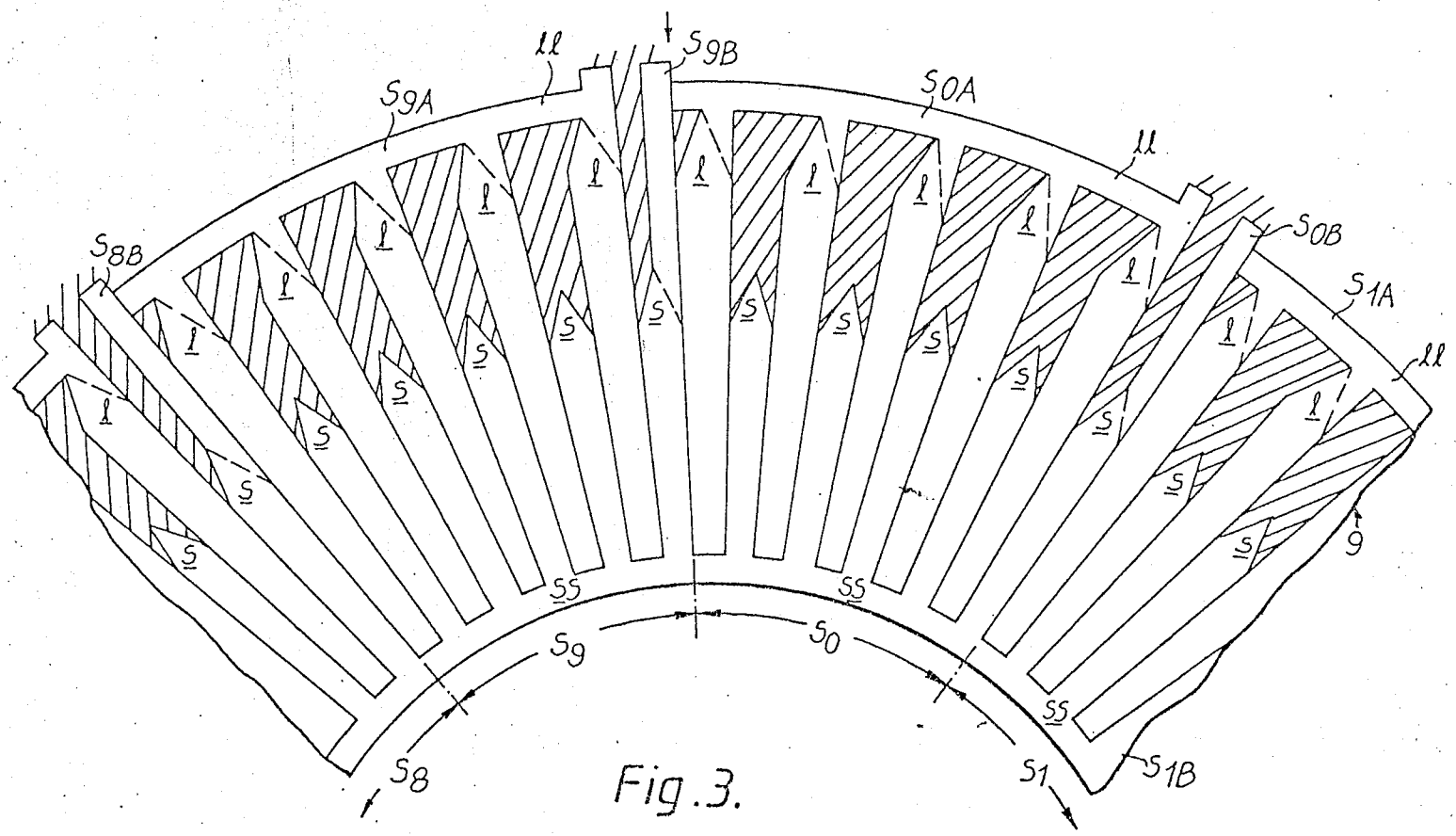
FIG. 3 is a detailed plan showing a portion of the back-plate electrodes shown in outline in FIG. 2.
Figure 4:
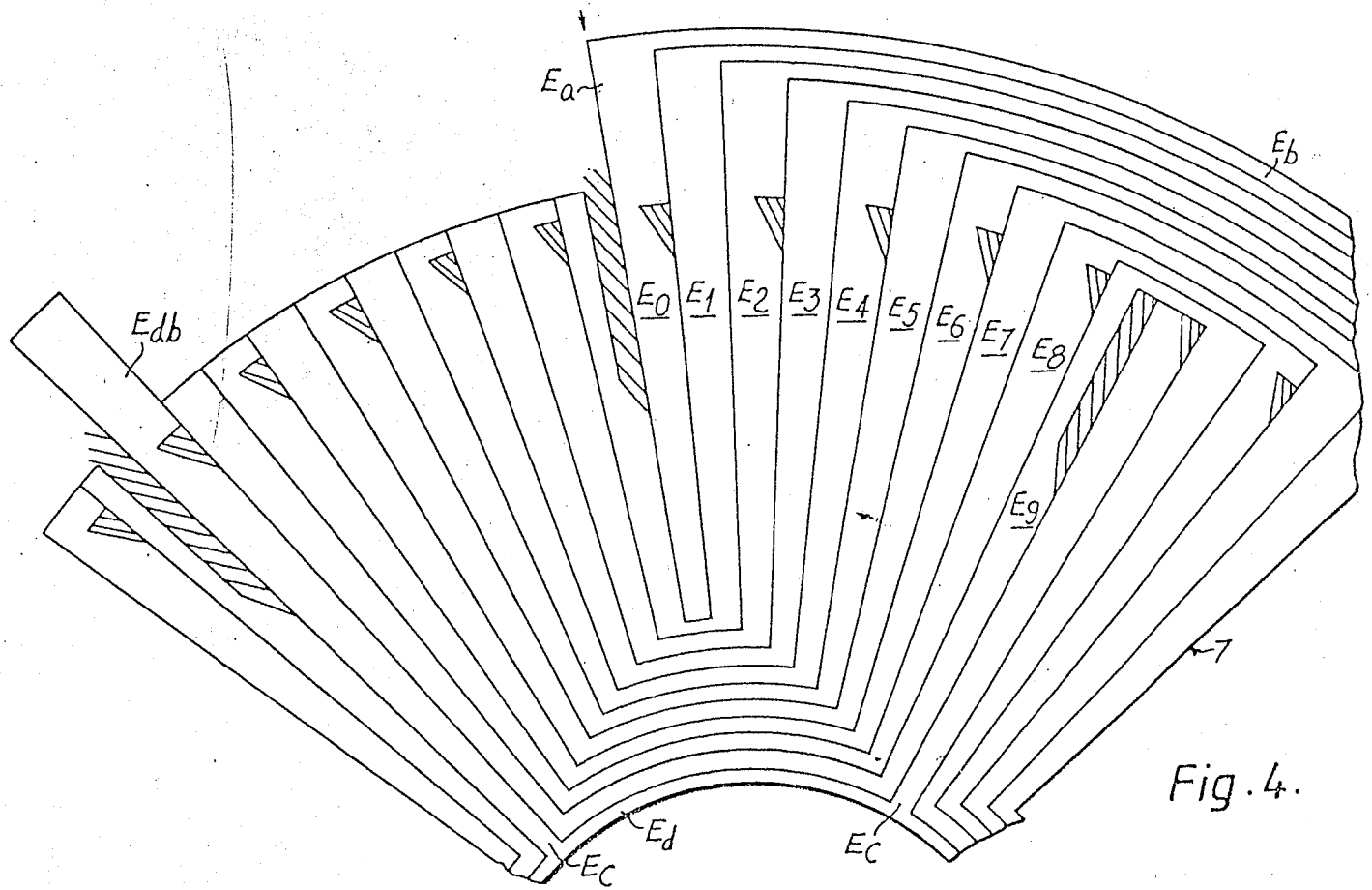
FIG. 4 is a detailed plan showing a portion of a set of front plate electrodes, the electrodes having a modified meander configuration suitable for over-lapping the back-plate electrodes shown in detail in FIG. 3.
Figure 5:
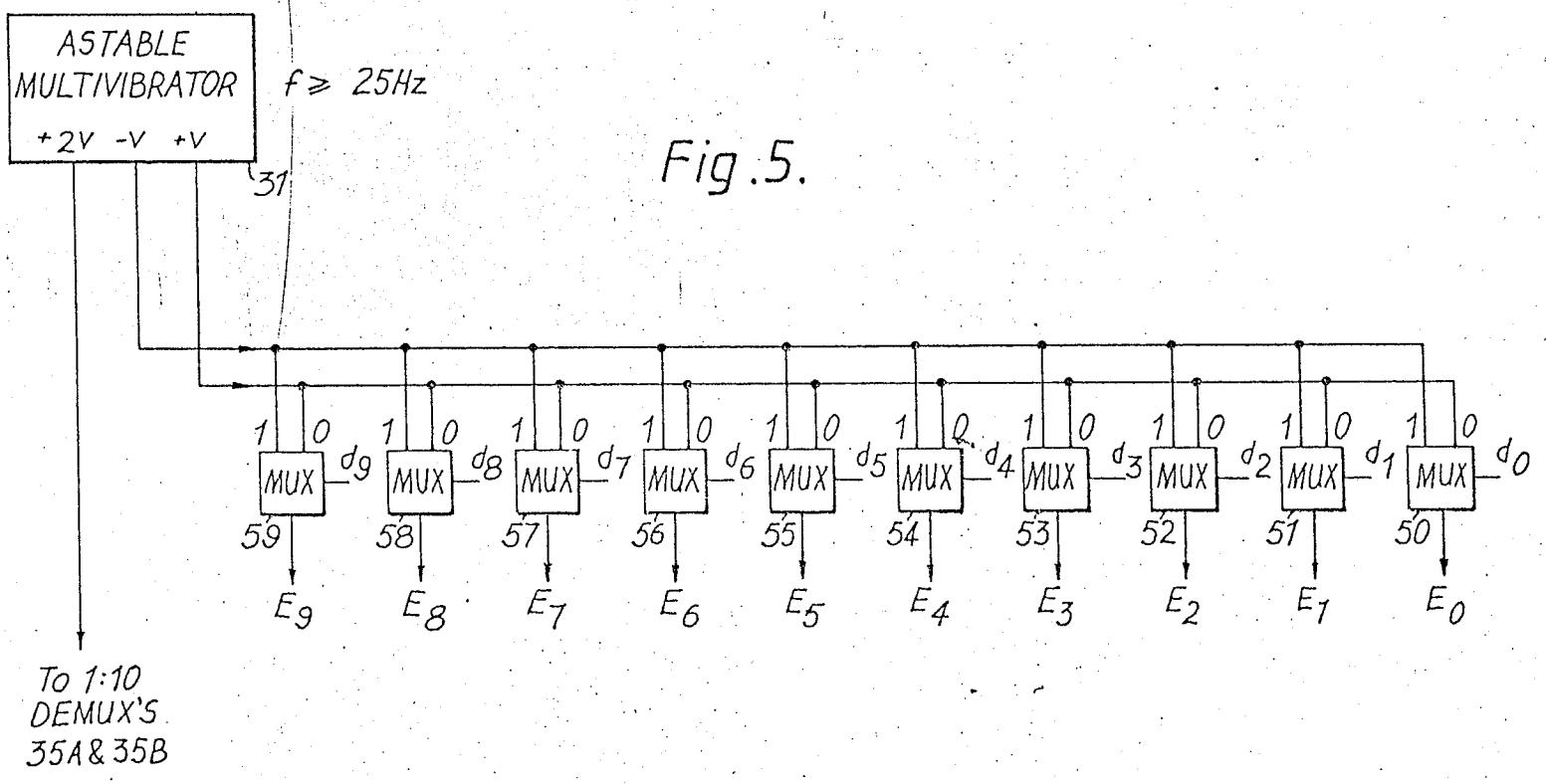
FIGS. 5 and 6 are circuit layout diagrams illustrating the arrangement of electronic components for operation of a display panel constructed as described below with reference to FIGS. 1 to 4.
Figure 6:
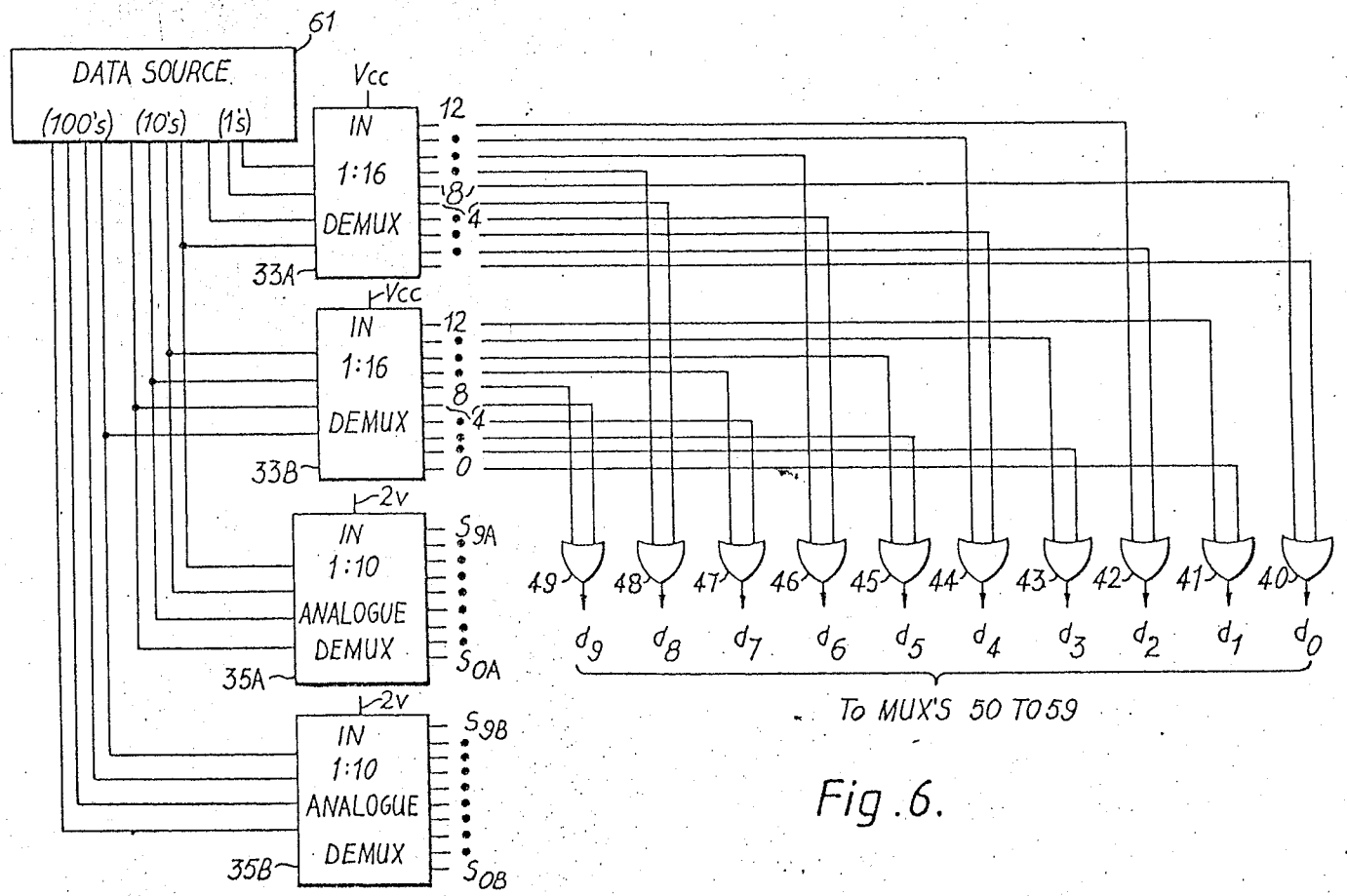

Alternate electrodes E0, E2 to E8 are shaped so that when the frontplate electrode structure 7 is superimposed, across the liquid crystal layer 11, upon the backplate electrode structure 9, in the position of registration indicated by arrows, FIGS. 3 and 4, electrically selectable index positions l each corresponding to regions having the shape of a long-hand pointer character are defined by the overlap of these electrodes E0, E2, . . . , E8 with the electrodes S0A to S9A. The electrode E9 is also shaped; and electrically selectable index positions s, each corresponding to regions having the shape of a short-hand pointer character, are similarly defined by the overlap of electrodes E1, E3, . . . , E9 with the electrodes S0B to S9B. Circuitry, for operating the display panel 1, described above, is shown in FIGS. 5 and 6.

Alternating electrical signals for driving the display are derived from a signal generator in the form of an astable multivibrator 31. Depending on the compatability of the voltages accepted by following selector logic and the voltages required to drive the panel 1, the signals provided by the astable multivibrator may be applied directly to the panel 1 through the selector logic, as shown, or alternatively they may be applied indirectly to the panel through the selector logic and thereafter through driver amplifiers to boost the provided voltages to the required driving levels. In this example the signals are applied directly to the panel 1 and have RMS magnitudes 2 $V_c$ and $V_c$, where the voltage $V_c$ is a voltage not greater than the threshold voltage $V_{th}$ at an operative temperature of the panel. These voltages may be compensated in a conventional manner by temperature sensitive scaling electronics (not shown), so that the display may be operated over a wider range of temperatures.

The signals are provided at three outputs of the multivibrator 31. There is provided at the first of these outputs a signal +2 V having RMS magnitude 2 $V_c$. At the second of these outputs there is provided a second signal $-V$, having RMS magnitude $V_c$, in anti-phase with the signal $+2$ V. At the third of these outputs there is provided a third signal $+V$, having RMS magnitude $V_c$, in phase with the signal $+2$ V. It is arranged that these signals have compatible waveforms so that the RMS difference between signals $+2$ V and $+V$ is of value $V_c$, and between signals $+2$ V and $-V$ is of value 3 $V_c$. The signals have a frequency $f\sqrt{25}$ Hz to avoid display flicker.

The selector logic, for controlling the selection of these signals and their application to the electrodes of panel 1, comprises: two 1:16 demultiplexers 33A, 33B; two 1:10 analogue demultiplexers 35A, 35B; ten OR gates 40 to 49; and, ten 2:1 multiplexers 50 to 59. Each of the demultiplexers 33A, 33B, 35A and 35B respond to digital data applied to their control inputs. The digital data is provided by a data source 61. This data source 61 may comprise a transducer (not shown), capable of responding to a scalar quantity, and an analogue to digital converter (not shown). The digital data is provided in binary-coded-decimal form at the binary coded hundreds (100's), tens (10's), and units (1's) outputs of the data source 61.

The tens and hundreds outputs of the data source 61 are connected to the control inputs of the 1:10 demultiplexers 35A and 35B, respectively. The demultiplexers 35A serves to channel the signal $+2$ V, applied at its signal input, onto one of its ten outputs according to the data address it receives. The ten outputs of demultiplexer 35A are connected to the outer segment electrodes S0A to S9A. Demultiplexer 35A controls the selection of a segment electrode to apply the signal $+2$ V, a zero voltage being applied to all the other segment electrodes connected to the outputs of this demultiplexer 35A. In similar manner, the demultiplexer 35B controls selection of one of the inner segment electrodes S0B to S9B. Thus demultiplexers 35A, 35B control segment selection for the selected positioning of the long-hand and short-hand, pointer indices, respectively.

Meander electrodes are selected by means of the two 1:16 demultiplexers 33A and 33B, the OR gates 40 to 49 and the multiplexers 50 to 59. In particular, the selection of the appropriate long-hand position is determined by the response of demultiplexer 33A. The control inputs of this demultiplexer 33A are connected to the three most significant bits of the units output, and to the least significant bit of the tens output, of the data source 61. Ten of the sixteen outputs of this demultiplexer 33A are connected in pairs to five of the OR gates 40, 42, . . . , 48. Demultiplexer outputs 0 to 4 are connected to OR gates 40, 42, 44, 46, 48 respectively, and demultiplexer outputs 8 to 12 are connected to OR gates 40, 48, 46, 44, 42. This arrangement of connections provides compensation for the modified meander order of the electrodes and thus ensures a unidirectional change of index position with progressive increase in the appropriate scale-value of the scalar quantity measured.

Demultiplexer 33B determines selection of the appropriate short-hand position. The control inputs of this demultiplexer 33B are connected to the three most significant bits of the tens output, and to the least significant bit of the hundreds output, of the data source 61. The outputs 0 to 4 of this demultiplexer 33B are connected to OR gates 41, 43, 45, 47 and 49 respectively, and outputs 8 to 12 to OR gates 49, 47, 45, 43 and 41 respectively.

The output of each OR gate 40 to 49 is connected to a corresponding multiplexer 50 to 59 at each control input d0 to d9. The output of each multiplexer 50 to 59 is connected to a corresponding one of the meander electrodes $E_0$ to $E_9$. Each multiplexer 50 to 59 has two signal inputs, one connected to the $-V$ signal output, the other to the $+V$ signal output, of the multivibrator 31. It is arranged that the $-V$ signal is channelled to a selected one of the electrodes E0 to E9 when a signal of digital '1' level is applied to the controlling input d0 to d9 of the corresponding selected multiplexer 50 to 59. To this end a digital '1' level control voltage $V_{cc}$ is applied to the signal input of demultiplexer 33A, and to the signal input of demultiplexer 33B. In consequence, and according to the data address applied to each demultiplexer 33A, 33B, digital '1' level signals are applied to each selected output 0 to 4 and 8 to 12 of both demultiplexers 33A and 33b, through one of the OR gates 40, 42, . . . , 48 and through one of the OR gates 41, 43, . . . , 49, to one of the multiplexers 50, 52, . . . , 58 and to one of the multiplexers 51, 53, . . . , 59. The $-V$ signal is then channelled by the selected multiplexers onto a selected one of the electrodes E0, E2, . . . , E8, and onto a selected one of the electrodes E1, E3, . . . , E9, for simultaneous positioning of the long-hand and the short-hand indices. There is thus a $+2$ V signal applied to a selected one of the segment electrodes S0A to S9A and to $+V$ signal applied to a selected one of the meander electrodes E0, E2, . . . , E8. At the intersection of these electrodes a voltage difference of RMS value 3 $V_c$ is developed and the region of the liquid crystal material 11 bounded by this intersection is driven and maintained in the bright optical ON state, this region having the form of a longhand position index character. Similarly, another selected region of the material is driven and maintained in the bright optical ON state, and has the form of a short-hand pointer index character. This region corresponds to the intersection of a selected one of the segment electrodes S0B to S9B and a selected one of the meander electrodes E1, E3, . . . , E9.

A digital '0' level voltage is applied by demultiplexers 33A and 33B through the remaining OR gates, onto the non-selected multiplexers. These non-selected multiplexers channel the $+V$ signal onto the remaining meander electrodes. Thus at all other intersections between the segment and meander electrodes, voltage signals $+2$ V and $+V$, 0 and $-V$, and 0 and $+V$ are applied across the liquid crystal material 11 and voltage differences, all of RMS magnitude $V_c$, developed. These regions of the liquid crystal material 11 are driven and maintained in the dark optical OFF state. Accordingly, the long-hand and short-hand pointer index characters appear against an optically contrasting background, each at a selected position on the dial display area.

With modification of the above circuit and simple redesign of the front and back-plate electrode structures 7, 9 a time-piece display may be provided. For example, the back-plate electrode 9 may be divided into twelve segments rather than ten. Accordingly, the 1:10 analogue demultiplexers 35A, 35B may be replaced by 1:12 analogue demultiplexers connected to the twelve segments. Selection control data may then be derived, not from an analogue-to-digital convertor, but from a data source consisting of a clocked divider/counter chain having suitable binary coded data outputs (eg 1-minute, 5-minute, 12-minute and 1-hour divider/counter outputs).

While in the above example, the segmented electrodes 9 are on the rear plate 5, and the meander electrodes 7 are on the front plate 3, their position is interchangeable.

In reflective devices, the use of a reflector 23 at the rear of rear plate 5 is not always desirable. Due to the parallax introduced, character definition can be degraded by shadowing. In preference, the rear electrodes may be constructed to be reflecting. For example they may be of thick film silver or aluminum. Preferably the reflecting electrodes are constructed to give diffuse reflection. Thus the thick film may be formed by deposit on a roughened plate surface, or the thick film may be provided with a rough finish by known deposit techniques.

Where, as just described, the rear electrodes 9 are of thick film, it also proves advantageous if these electrodes 9 are those of meander configuration. In this case the higher conductivity of the thick film thus allows a reduction in the voltage drop that occurs along the length of each meander electrode, this voltage drop arising from unavoidable leakage current associated with capacitive, inductive effects as well as conductance through the electrically sensitive medium.

Figure 7:
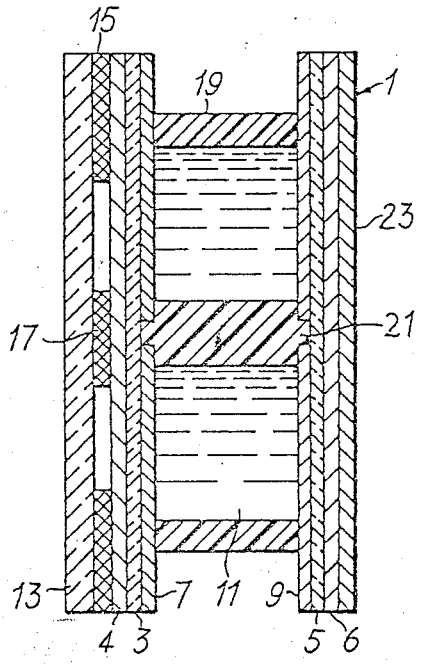
FIG. 7 is an illustrative cross-section of a twisted-nematic effect display panel.

As shown in FIG. 7, there is twisted nematic effect panel 1 comprising front and back glass plates 3 and 5 bearing on their inner facing surfaces, electrode structures 7 and 9. An electrically sensitive medium 11 of liquid crystal material for example, the nematic mixture E7 containing 1 wt% of C15 cholesteric mixture [E7, C15 mixtures are listed in the catalogues of BDH Ltd, Poole, Dorset, England], is enclosed between these electrode structures 7, 9 and the molecules of this material are (in the OFF state) constrained to adopt a 90° helical twist. Two polarizers 4 and 6 are arranged one adjacent each plate 3 and 5. The polarizers are crossed with respect to each other and aligned parallel with or perpendicular to the alignment direction of the liquid crystal on the electrode bearing plates 3 and 5 so that in the absence of applied field, ie in the OFF state, light may be transmitted through the polarizers.

Thus when the electrode structures 7 and 9 are constructed and arranged in the manner of the structures described above, and address signals are applied by the circuitry also described above, dark characters (ON state) may be displayed against a bright background (OFF state). It is an advantage of this construction of a twisted nematic effect panel diaplay that the bright background corresponds to the OFF state where the molecules of the liquid crystal material are arranged with their long axes arranged in a helical twist. This arrangement give little change in the transmission of the display with angle so that the display may be viewed and/or illuminated over a wide range of angles without substantial change in either the contrast or the brightness.

I claim:

1. An analogue display comprising in combination:

a display panel;

address means for providing a set of voltage signals to operate the display panel; and, selector means, capable of response to input data, for selecting voltage signals from the address means, and for applying these signals to the display panel to enable display of two indices on the display panel against an otically contrasting background; wherein, the display panel includes: two parallel substrates;

an electrically sensitive medium contained between the two substrates, the medium being capable of adopting simultaneously in different regions thereof each of two optical states, an ON state, and an OFF state, respectively, in response to different electrical fields developed thereacross;

a first set of electrodes arranged in a plurality of segments, each segment being divided into an inner and an outer portion, each portion being planar and having a plurality of joined digits, the digits of one portion being interposed alternate with and in between the digits of the other portion, the first set of electrodes being mounted on the inwardly facing surface of the first substrate, and connected to the selector means; and a second set of electrodes having a configuration in which a single electrode is interposed between meandering electrodes in folds formed by the meandering electrodes to form collectively a modified meander structure, the second set of electrodes being mounted on the inwardly facing surface of the second substrate, and connected to the selector means;

the two sets of electrodes being registered one set over the other with alternate digits and alternate meander electrodes defining two subsets of selectable index positions each subset to display a different index; and, the selector means being constructed to respond to input data and connected to the two sets of electrodes to drive the panel medium in the ON state at two different selected index positions simultaneously, the panel medium being in the OFF state at all other selectable index positions.

2. A display according to claim 1 wherein the medium is of liquid crystal material.

3. A display according to claim 2 wherein the panel is a dyed cholesteric to nematic phase change device, the material being cholesteric and containing at least one pleochroic dye.

4. A display according to claim 3 wherein the pleochroic dye is an anthraquinone dye having the formula:

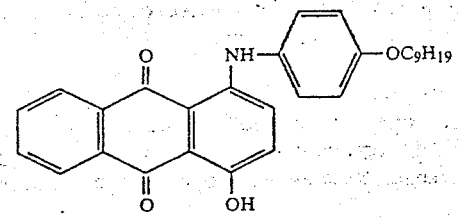

5. A display according to claim 3 wherein the display panel includes reflector means arranged to reflect light transmitted through the liquid crystal material.

6. A display according to claim 5 wherein the reflector means is provided by one of the two sets of electrodes, this set of electrodes being of thick reflective, electrically conductive film material.

7. A display according to claim 6 wherein the reflector means is provided by the second set of electrodes.

8. A display according to claim 2 wherein the panel includes two polarizers one to the outside of each substrate, the liquid crystal material is capable of adopting a 90° helical twist between the two sets of electrodes, and, the two sets of electrode bearing surfaces and liquid crystal material interact so that the liquid crystal material adopts this helical twist in the OFF state, the two polarizers being aligned relative to each other and to the electrode bearing substrates so to provide a twisted nematic effect device.

9. A display according to claim 8 wherein the two polarizers are crossed and aligned parallel or perpendicular to the liquid crystal alignment directions on the electrode bearing surfaces so to transmit light in the OFF state.

10. A display according to claim 1 wherein the two sets of electrodes are configured to provide a dial shaped display area.

11. A display according to claim 1 wherein the address means is constructed to provide a set of alternating voltage signals (+2 V, +V, −V), the signals +V and −V, respectively, being in-phase and in anti-phase with the signal +2 V, and such that the set of signals, when applied to the panel, have RMS magnitudes (2 $V_c$, $V_c$, $V_c$), the voltage magnitude $V_c$ being no greater than the threshold voltage of the display panel, the selector means being constructed to develop an RMS voltage difference of magnitude 3 $V_c$ across the two different selected index positions, and an RMS voltage difference of magnitude $V_c$ across the other selectable index positions.

12. A display according to claim 11 wherein the set of voltage signals have RMS magnitudes (2 $V_c$, $V_c$, $V_c$) and are applied directly to the panel.

13. A display according to claim 1 wherein the address means is constructed to provide a set of alternating voltage signals (+2 V, +V, −V) which have added thereto a common voltage signal $\Delta V$, the selector means being constructed to apply signals (+2 V+$\Delta V$, +V+$\Delta V$, −V+$\Delta V$, and $\Delta V$) to the display panel so to develop an RMS voltage difference of magnitude 3 1 $V_c$ across the two different selected index positions, and an RMS voltage difference of magnitude $V_c$ across the other selectable index positions.

14. An analogue display comprising in combination:

a display panel;

address means for providing a set of voltage signals to operate the display panel;

a data source; and, selector means, responsive to the data source, for selecting voltage signals from the address means, and, for applying these signals to the display panel to enable display of two indices on the display panel against an optically contrasting background;

wherein, the display panel includes:

two parallel substrates;

an electrically sensitive medium contained between the two substrates, the medium being capable of adopting simultaneously in different regions thereof each of two optical states, an ON state, and, an OFF state, respectively, in response to different electrical field developed thereacross;

a first set of electrodes arranged in a plurality of segments, each segment being divided into an inner and an outer portion, each portion being planar and having a plurality of formed digits, the digits of one portion being interposed alternate with and in between the digits of the other portion, the first set of electrodes being mounted on the inwardly facing surface of the first substrate, and connected to the selector means; and, a second set of electrodes having a configuration in which a single electrode is interposed between meandering electrodes in folds formed by the meandering electrodes to form collectively a modified meander structure, the second set of electrodes being mounted on the inwardly facing surface of the second substrate, and connected to the selector means;

the two sets of electrodes being registered one set over the other with alternate digits and alternate meander electrodes defining two subsets of selectable index positions each subset to display a different index; and, the selector means being constructed to respond to input data and connected to the two set of electrodes to drive the panel medium in the ON state at two different selected index positions simultaneously, the panel medium being in the OFF state at all other selectable index positions.

15. An analogue display according to claim 14 arranged as a meter display, the data source being capable of response to measured variation of a physical variable and of providing digital input data as a measure thereof; and the first set of electrodes being arranged in ten segments.

16. An analogue display according to claim 14 arranged as a time-piece, the data source consisting of an oscillator and a divider chain to provide digital input data as a measure of time; and, the first set of electrodes being arranged in twelve segments.

* * * * *

4342030
DUBOSE / BOX 711 U 54 082
ACCESSION #50-137
JEANETTE GATLING
2 STAPLES AT BOTTOM
05260695 ZIP:
SEND TO MAILROOM
05/26
TL
X964